US012698612B2

(12) United States Patent
Lingel et al.

(10) Patent No.: US 12,698,612 B2
(45) Date of Patent: Aug. 4, 2026

(54) MACHINERY IMPLEMENT COUPLING APPARATUS

(71) Applicant: DAEQUIP PREMIUM ATTACHMENTS LTD, Surrey (CA)

(72) Inventors: Ed Lingel, Surrey (CA); Steve Tudhope, Surrey (CA)

(73) Assignee: DAEQUIP PREMIUM ATTACHMENTS LTD., Surrey (CA)

( * ) Notice: Subject to any disclaimer, the term of this patent is extended or adjusted under 35 U.S.C. 154(b) by 366 days.

(21) Appl. No.: 18/480,016

(22) Filed: Oct. 3, 2023

(65) Prior Publication Data

US 2025/0109567 A1 Apr. 3, 2025

(51) Int. Cl.
*E02F 3/36* (2006.01)

(52) U.S. Cl.
CPC ..... *E02F 3/364* (2013.01); *E02F 3/3663* (2013.01)

(58) Field of Classification Search
CPC ..... E02F 3/364; E02F 3/3663
See application file for complete search history.

(56) References Cited

U.S. PATENT DOCUMENTS 7,654,019 B2 * 2/2010 Yeager ..... E02F 3/365 37/468
8,602,676 B2 * 12/2013 Stollery ..... E02F 3/365 403/325
9,970,177 B2 * 5/2018 Koestler ..... E02F 3/365

FOREIGN PATENT DOCUMENTS

CA 3065730 A1 * 6/2021 ..... E02F 3/3663

* cited by examiner

*Primary Examiner* — Matthew R Buck
(74) *Attorney, Agent, or Firm* — Orin Del Vecchio

(57) ABSTRACT

An implement coupling apparatus configured to facilitate coupling and de-coupling of an implement such as but not limited to a bucket from the operator's cab of the machinery. The invention includes a first side plate member and a second side plate member each having a first end a second end. Lug apertures and lugs are present on each side member being configured to engage hub notches of an implement. A wedge bar member is operably disposed between the first side plate member and second side plate member and is movable between a first and second position. The wedge bar member includes opposing ends that protrude beyond the first side plate member and second side plate member. A spring assembly having two compression springs is operably coupled to the wedge bar member. A control cylinder is operably coupled to the wedge bar member to provide movement thereof.

11 Claims, 6 Drawing Sheets

MACHINERY IMPLEMENT COUPLING APPARATUS

FIELD OF THE INVENTION

The present invention relates generally to heavy machinery implements, more specifically but not by way of limitation, a coupling apparatus that is configured to facilitate coupling of implements such as but not limited to buckets to an arm of heavy equipment such as but not limited to an excavator, wherein the present invention facilitates an ability to connect and disconnect the implement from the operator cab of the machinery.

BACKGROUND

Various types of industries employ heavy equipment such as but not limited to excavators to perform needed tasks. All of these industries are very focused on personnel safety as tens of thousands of work place accidents occur every year that involve some type of heavy machinery. Most of the heavy equipment employs hydraulics to move machine parts as well as control operable connection between different parts of the machine. Hydraulic couplers are quite common and are utilized to connect implements such as but not limited to buckets. Many styles of conventional hydraulic couplers require the operator to exit the operator cab and physically install a wedge bar safety bar that is operable to prevent the wedge bar from accidental disengagement in the event of a hydraulic failure. These conventional system are actuate by a double acting hydraulic cylinder which can expose the coupler device to expensive damages and downtime if not used correctly by an operator.

Another issue with conventional coupler devices is a problem known in the art as clipping. The coupler device wedge bar can contact on top of the attachment when it is not in a full release position. When this occurs, the impact energy of the clipping transfers directly to the double acting cylinder that is fastened to the coupler and the wedge bar which in turn can result in a premature force on the wedge bar that will damage the hydraulic cylinders.

Accordingly, there is a need for an improved coupling device that facilitates an ability for a machine operator to couple an implement from the operator cab of the machinery and further be equipped with a single acting cylinder with large engaging coil springs that absorb the energy of clipping if it occurs.

SUMMARY OF THE INVENTION

It is the object of the present invention to provide a machinery implement coupling device configured to facilitate coupling of an implement from the cab of the machinery wherein the present invention includes a body having a first side plate member and a second side plate member.

Another object of the present invention is to provide an implement coupling device for machinery implements wherein the first side plate member and second side plate member have lug apertures formed therein.

A further object of the present invention is to provide a machinery implement coupling device configured to facilitate coupling of an implement from the cab of the machinery wherein the present invention includes a wedge bar assembly intermediate the first side plate member and second side plate member.

Yet a further object of the present invention is to provide an implement coupling device for machinery implements wherein the wedge bar assembly includes a first spring over hydraulic member and a second spring over hydraulic member.

Still another object of the present invention is to provide a machinery implement coupling device configured to facilitate coupling of an implement from the cab of the machinery wherein the wedge bar assembly has operably coupled thereto a control cylinder.

An additional object of the present invention is to provide an implement coupling device for machinery implements wherein the present invention further includes a controller mounted in the operator cab of the machine that which the present invention is operably coupled thereto.

Yet a further object of the present invention is to provide a machinery implement coupling device configured to facilitate coupling of an implement from the cab of the machinery wherein the wedge bar assembly includes a wedge bar member having a first and second end that extend outward from apertures in the first side plate member and second side plate member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
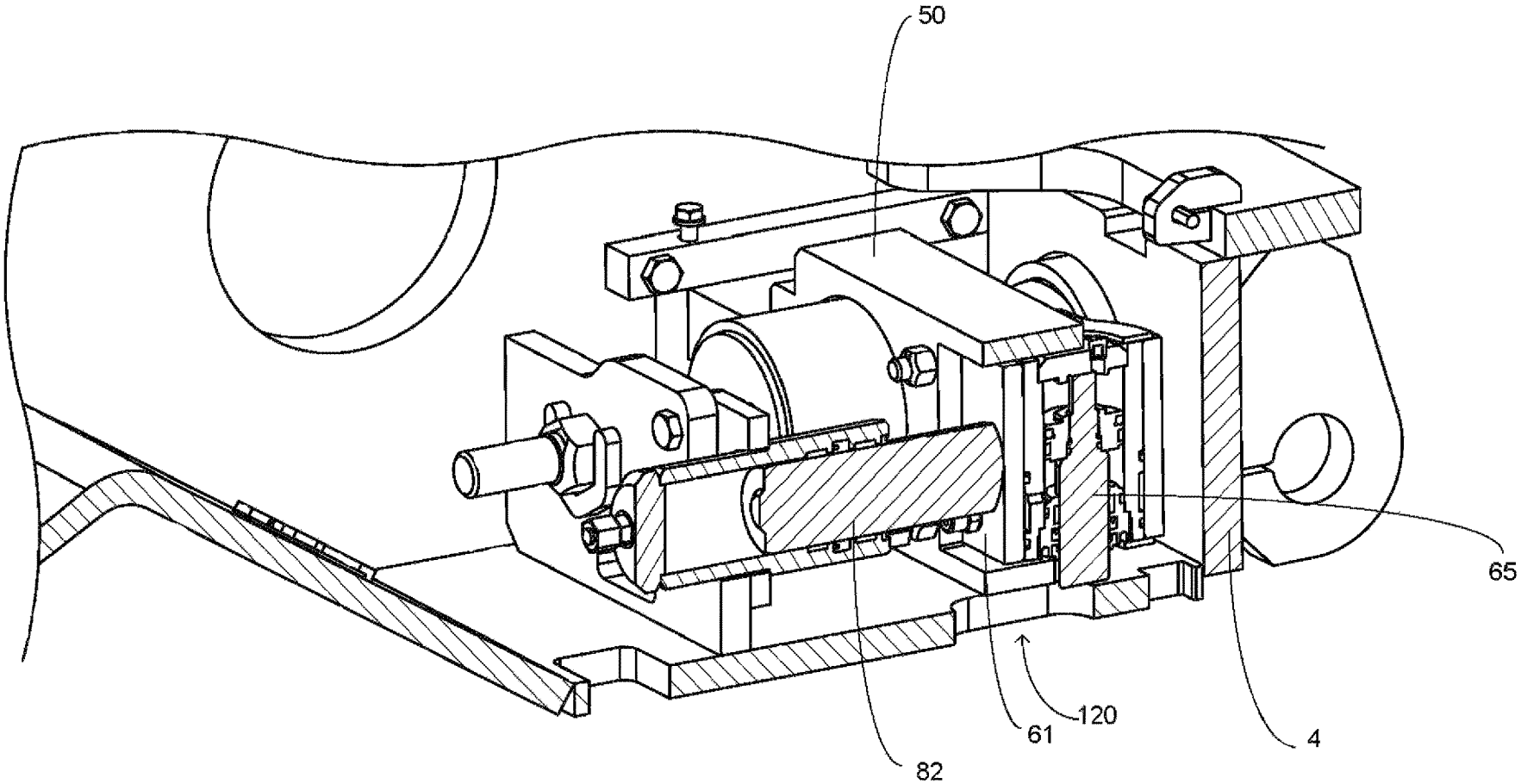
FIG. 1 is a cross-sectional view of the wedge bar assembly in a first position.

Referring now to the drawings submitted herewith, wherein various elements depicted therein are not necessarily drawn to scale and wherein through the views and figures like elements are referenced with identical reference numerals, there is illustrated an implement coupling apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the implement coupling apparatus 100 is deployed for machinery such as but not limited to excavators wherein the present invention can be utilized to operably couple a bucket to an arm member of the excavator. It should be understood within the scope of the present invention that utilization of an excavator and bucket is exemplary only and does not serve to provide any limitation of implement and/or machinery. The implement coupling apparatus 100 includes a first side plate member 10 and a second side plate member 25. The first side plate member 10 and second side plate member 25 are identically constructed and as such the ensuing description of the first side plate member 10 and the elements thereof should be understood to apply to the second side plate member 25. The first side plate member 10 includes a first end 11 and second end 12. A first lug aperture 13 is formed in the first side plate member 10 proximate the first end 11. The first lug aperture 13 is configured to receive lugging 14 wherein lugging 14 is operably coupled to the first lug aperture 13 utilizing suitable techniques. The lugging 14 extends outward from the first side plate member 10 and is configured to engage hub notch 15 formed on the exemplary bucket implement 99 (only top end thereof illustrated herein).

A second lug aperture 16 is formed in the first side plate member 10 proximate the second end 12. The second lug aperture 16 has lugging 17 operably coupled thereto employing durable suitable techniques. Lugging 17 extends outward from the first side plate member 10 and is configured to operably couple with hub notch 18 during the coupling of the implement coupling apparatus 100 with bucket implement 99. Formed in the first side plate member 10 intermediate the second end 12 and the second lug aperture 16 is wedge bar aperture 20. The wedge bar aperture 20 is generally rectangular in shape and of suitable size to permit opposing ends 51,52 of the wedge bar member 50 extend outward therefrom as is further discussed herein. It should be understood within the scope of the present invention that the first side plate member 10 and second side plate member 25 could be manufactured in alternate sizes and shapes in order to operably couple with a machinery implement.

The implement coupling apparatus 100 includes wedge bar member 50. The wedge bar member 50 as is discussed herein is movable between a first position and a second position to facilitate the coupling and locking of the bucket implement 99. The wedge bar member 50 is manufactured from a suitable durable material such as but not limited to metal. The wedge bar member 50 includes a center section 53 having opposing ends 51, 52 contiguously formed therewith wherein end 51,52 have a thickness that is less than that of the center section 53. Ends 51, 52 are wedge shaped having an angular upper surface wherein the upper surface functions to biasly engage the coupling notch 98 in the bucket implement 99 wherein the angle of the upper edge 97 of the coupling notch 98 and the upper surface 54 of the ends 51,52 are mateable. Ends 51, 52 extend beyond the first side plate member 10 and second side plate member 25 respectively at a distance sufficient to extend slightly beyond the outer sides of the bucket implement 99 proximate the coupling notch 98.

The wedge bar member 50 further includes lock assembly aperture 57 formed in the center section 53. The lock assembly aperture 57 is generally square in shape and has operably coupled therein the lock assembly 60 that is further discussed herein. A first spring aperture 58 and a second spring aperture 59 are formed in the wedge bar member 50 on opposing side of the lock assembly aperture 57. The first spring aperture 58 and second spring aperture 59 are configured to operably couple with spring retainers 71,72 of the spring assembly 70 that is further discussed herein. It should be understood within the scope of the present invention that the wedge bar member 50 could include alternate elements as needed to operably couple with additional elements of the implement coupling apparatus 100. Furthermore, alternate quantities of elements such as the first spring aperture 58 and second spring aperture 59 could be employed for application of the implement coupling apparatus 100 that utilized more or less than two springs for the spring assembly 70. An upper cover member 5 and lower cover member 6 are secured across the implement coupling apparatus 100 between the first side plate member 10 and second side plate member 25 and are operable to protect the elements therebetween from dirt and debris.

The spring assembly 70 functions to apply force to the wedge bar member 50 so as to maintain the wedge bar member 50 operably coupled with the bucket implement 99. The spring assembly 70 includes a first spring member 75 and a second spring member 76 that are identically constructed and as such the ensuing discussion of the first spring member 75 should be understood to apply to the second spring member 76. First spring member 75 includes spring retainer 71, spring member 77, spring retainer 78 and bolt member 79 operably coupled. The first spring member 75 is biasly mounted against wall member 4 wherein wall member 4 extends between first side plate member 10 and second side plate member 25 proximate the second end thereof. The first spring member 75 applies force to the wedge bar member 50 so as to maintain the engagement of the wedge bar member 50, specifically the ends 51,52 thereof with coupling notch 98. As is further discussed herein control cylinder 80 provides opposing force to the wedge bar member 50 when activated by controller 110 so as to move the wedge bar member 50 to its first position wherein the ends 51,52 of the wedge bar member 50 are more proximate second end 12 in order to facilitate coupling of the bucket implement 99, specifically wherein ends 51, 52 are moved so as to inhibit contact with end 96.

The control cylinder 80 is operably coupled to mounting bar 81 wherein the mounting bar 81 is operably coupled intermediate the first side plate member 10 and second side plate member 25 utilizing suitable durable techniques. The control cylinder 80 is a hydraulic cylinder having piston 82 that is movable in an inwards-outwards direction. The control cylinder 80 is operably coupled to controller 110 utilizing conventional hydraulic lines (not illustrated herein). Controller 110 is mounted in an operator cab of the machinery to which the implement coupling apparatus 100 is operably coupled thereto. Piston 82 biases against housing 61 of the lock assembly 60 in order to move the wedge bar member 50 intermediate its first position and its second position. While one control cylinder 80 is illustrated herein, it is contemplated within the scope of the present invention that the implement coupling apparatus 100 could employ more than one control cylinder 80 to facilitate movement of the wedge bar member 50.

Figure 2:
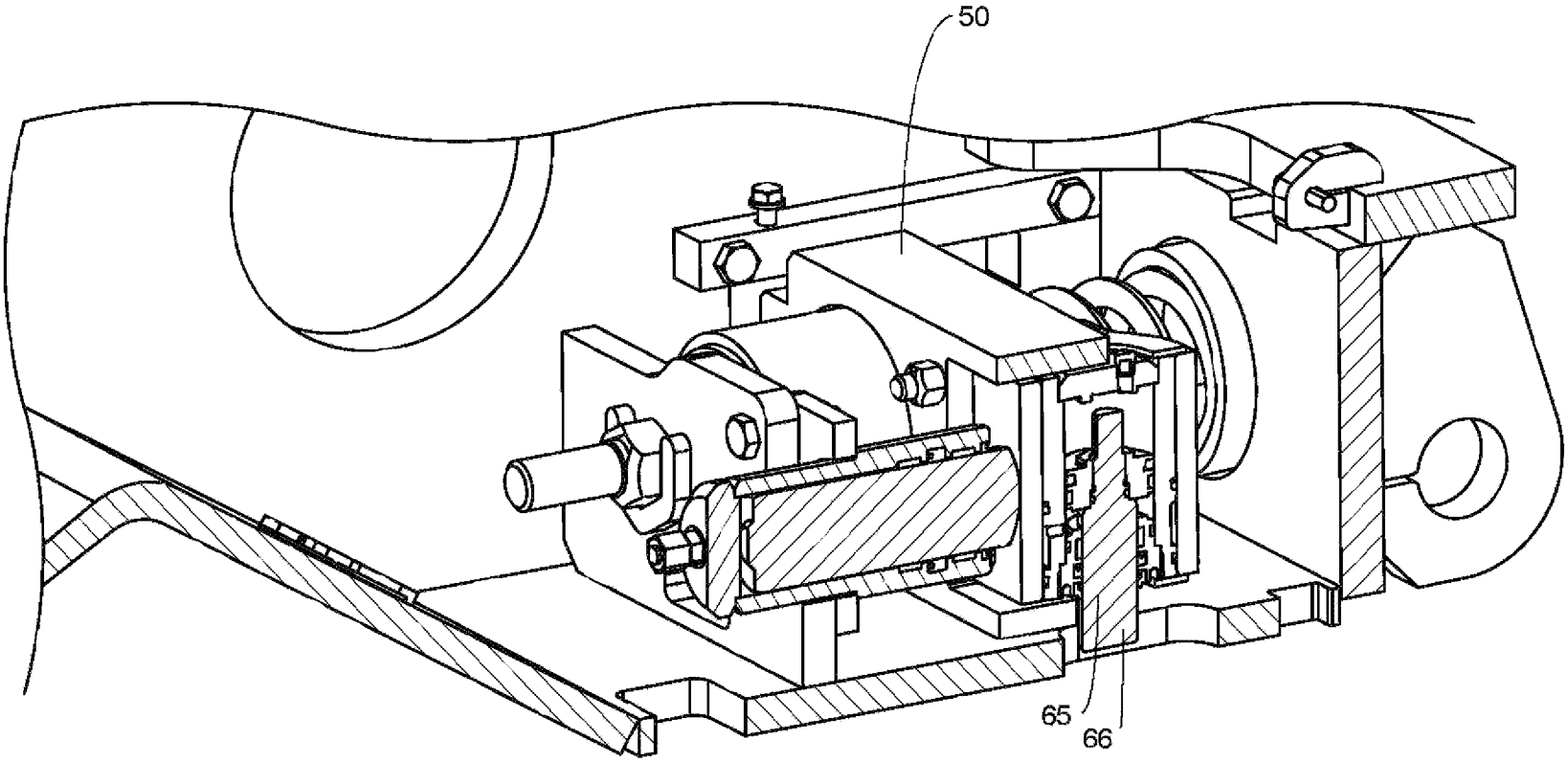
FIG. 2 is a cross sectional view of the wedge bar assembly in a second position.
Figure 3:
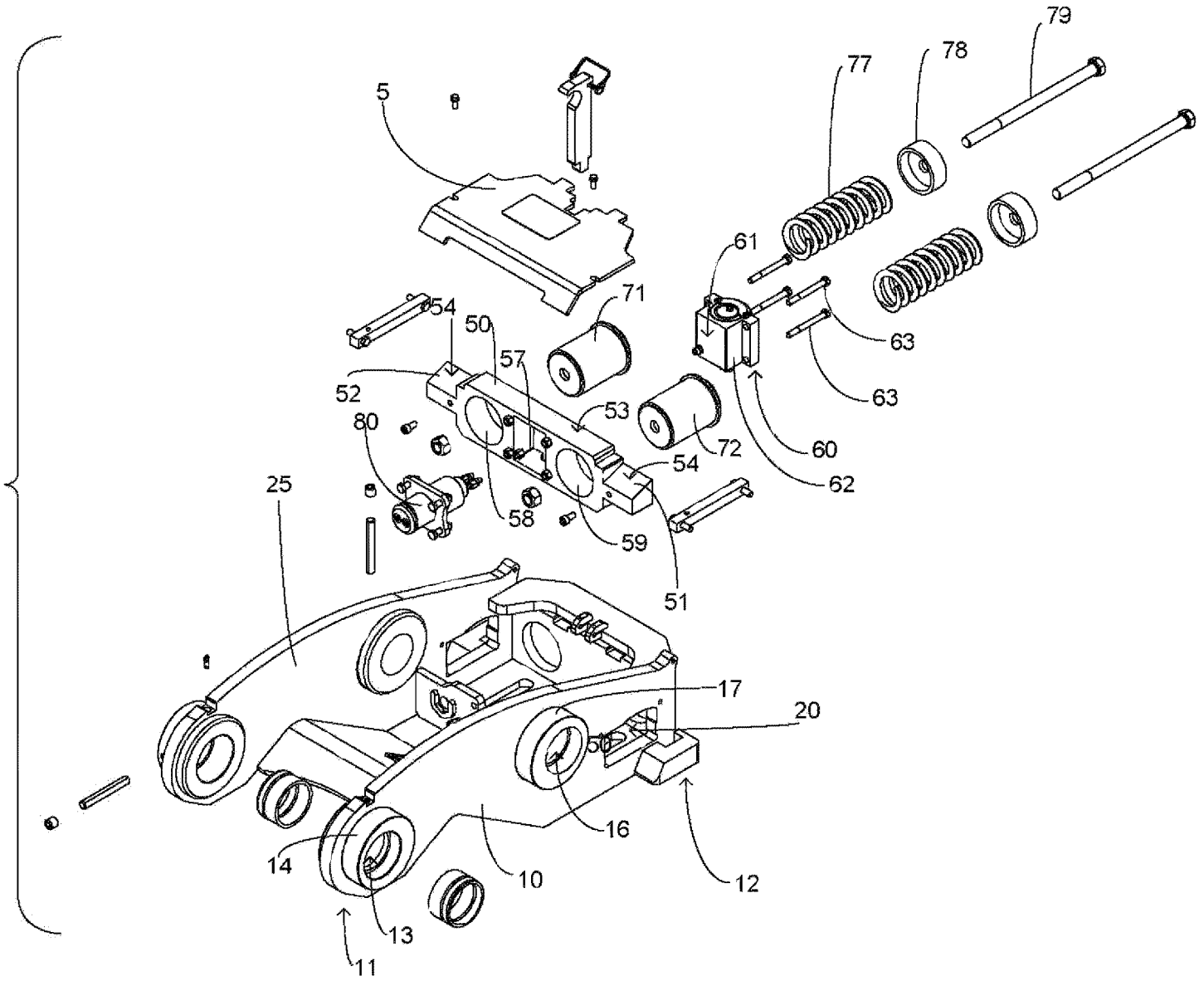
FIG. 3 is an exploded parts view of the present invention.
Figure 4:
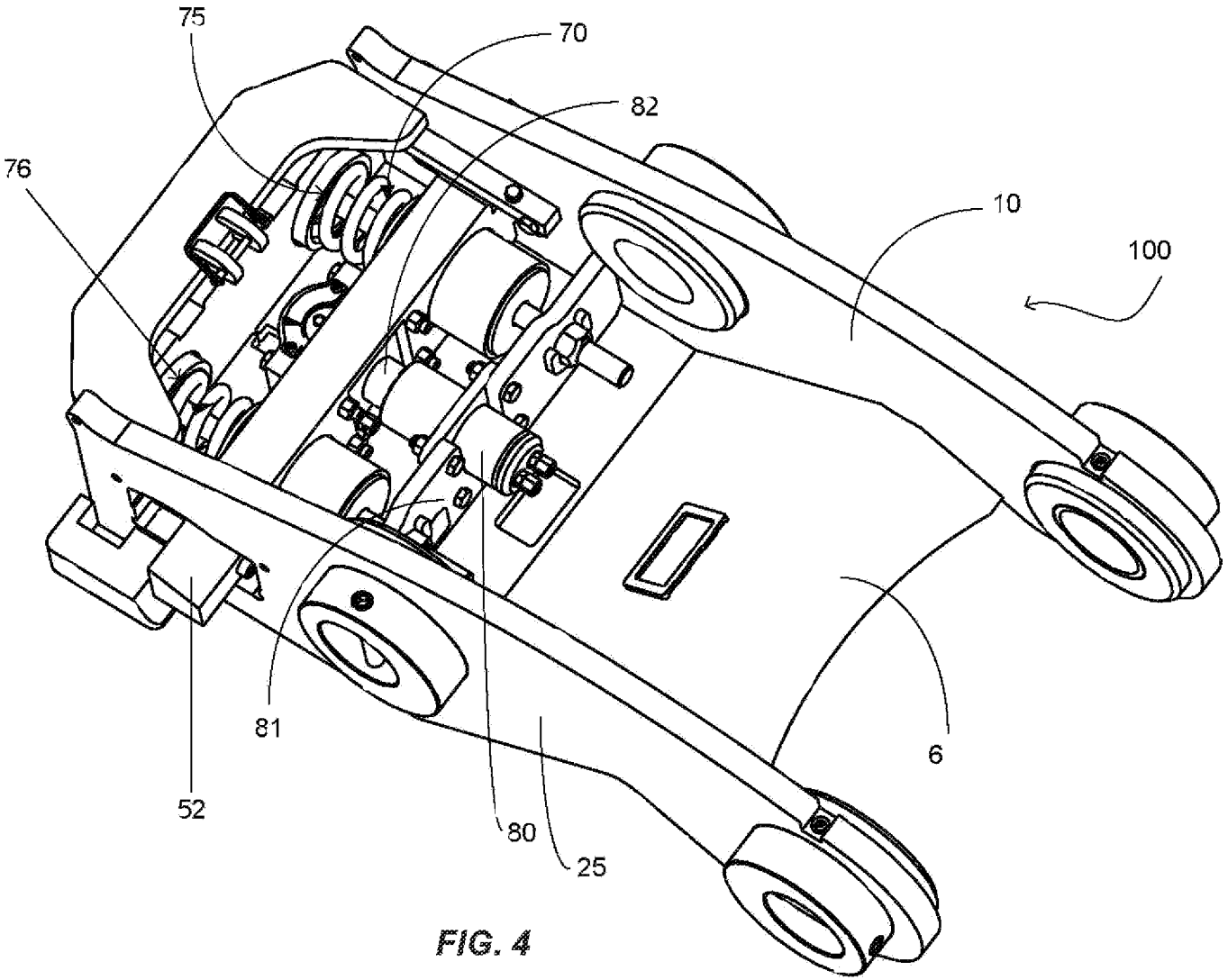
FIG. 4 is a top view of the present invention with the cover plate member removed.
Figure 5:
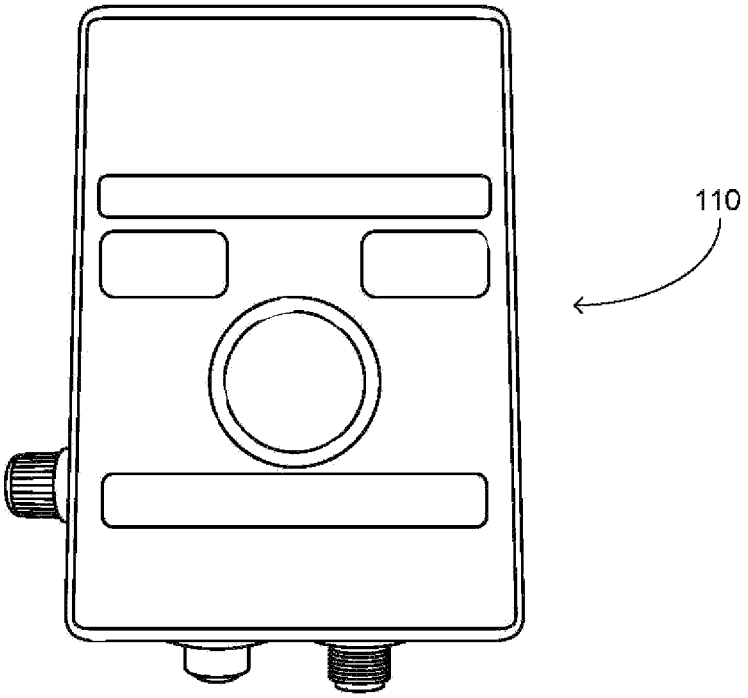
FIG. 5 is a front view of an exemplary controller.
Figure 6:
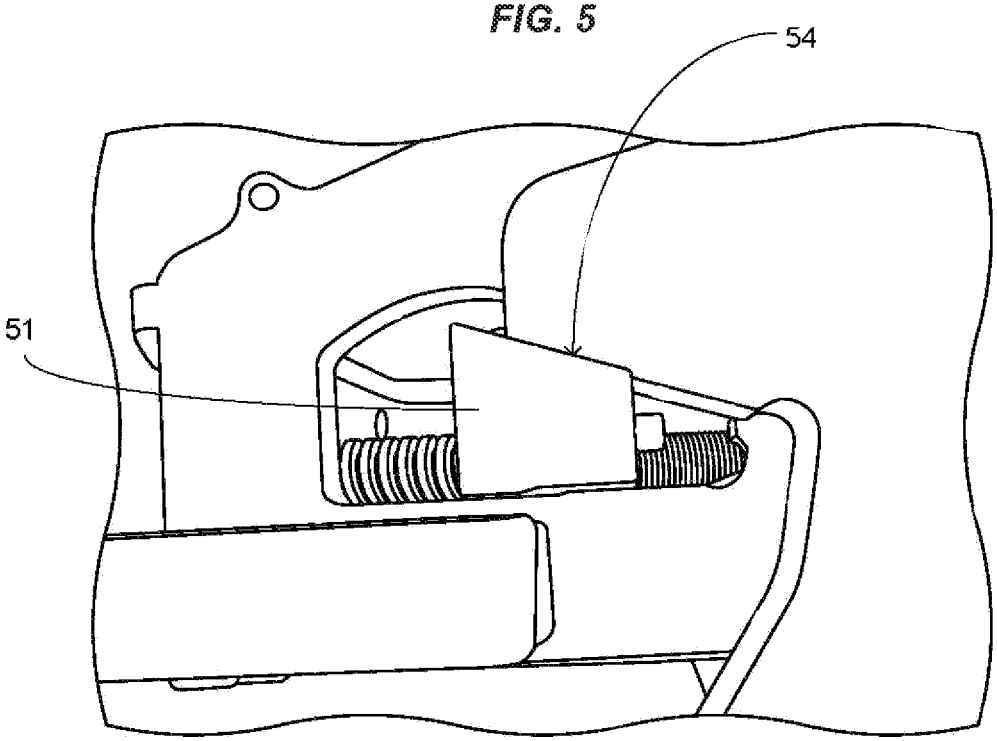
FIG. 6 is a detailed view of an end of the wedge bar member.
Figure 7:
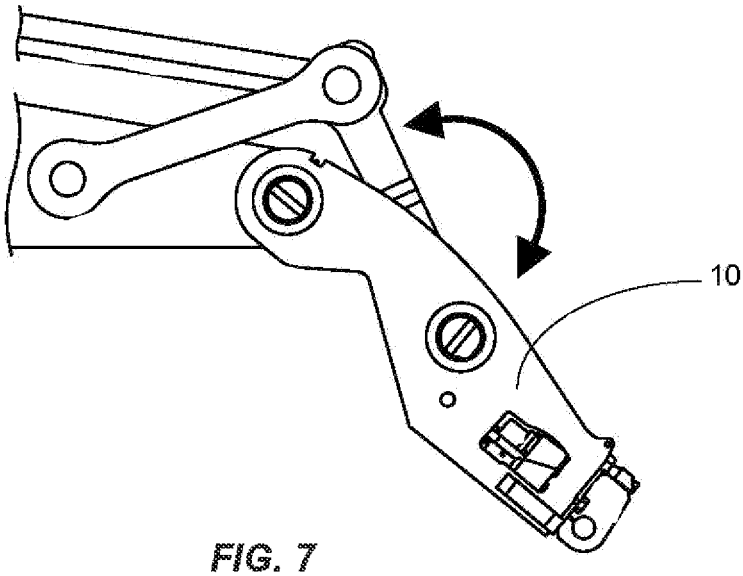
FIG. 7 is a side view of the present invention coupled to a machine arm with the wedge bar member in its first position.
Figure 8:
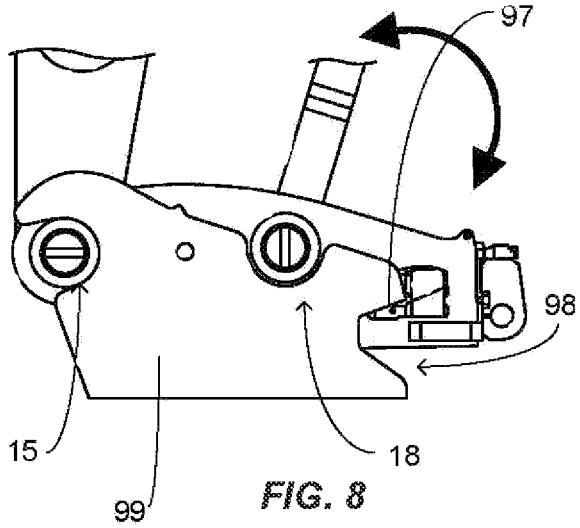
FIG. 8 is a side view of the present invention during coupling with an exemplary implement.
Figure 9:
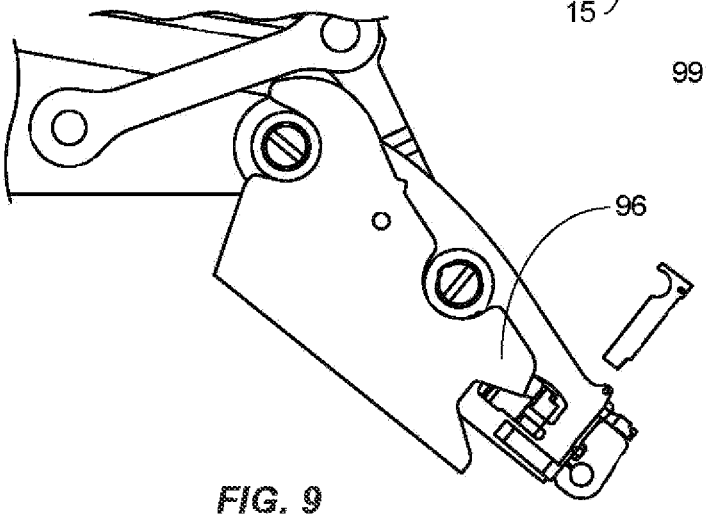
FIG. 9 is a side view of the present invention coupled with an exemplary implement with the wedge bar member in its second position.

The lock assembly 60 is operably coupled to wedge bar member 50. The housing 61 of the lock assembly 60 includes a portion 62 that mateably couples to the lock assembly aperture 57 in the wedge bar member 50 wherein fasteners 63 are employed to secure housing 61 to the wedge bar member 50. The lock assembly 60 functions to lock the wedge bar member 50 in its second position ensuing engagement with bucket implement 99. The lock assembly 60 includes pin member 65 movably disposed in the housing 61. Pin member 65 is movable in an upwards-downwards direction as is illustrated herein in FIG. 1 and FIG. 2. In FIG. 1 submitted herewith, the pin member 65 is moved upwards prior to the piston 82 applying force to move the wedge bar member 50 to its first position. The pin member 65 is moved upwards in order to avoid engagement with aperture 120 formed in lower cover member 6 thus allowing movement of the wedge bar member 50. As is illustrated herein in FIG. 2, the pin member 65 is in its second position wherein the lower end 66 extends into aperture 120 thus locking the wedge bar member 50 into its second position to secure bucket implement 99.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An implement coupling apparatus configured to facilitate coupling and de-coupling of an implement to machinery wherein the implement coupling apparatus comprises:

a body, said body having a first side plate member and a second side plate member located on opposing sides of the body, said first side plate member and said second side plate member being parallel and operably coupled, said first side plate member having a first end and a second end, said second side plate member having a first end and a second end, said first side plate member having a first lug aperture and a second lug aperture distally located on said first side plate member, said second side plate member having a first lug aperture and a second lug aperture being axially aligned with the first lug aperture and the second lug aperture formed in said first side plate member, said body having a rear wall, said rear wall extending intermediate said first side plate member and said second side plate member being perpendicular thereto, said first side plate member having a wedge bar aperture, said second side plate member having a wedge bar aperture being axially aligned with said wedge bar aperture of said first side plate member, a wedge bar member, said wedge bar member being movably disposed within said body intermediate said first side plate member and said second side plate member, said wedge bar member having a first end and a second end, said first end of said wedge bar member extending outward beyond said first side plate member, said second end of said wedge bar member extending outward beyond said second side plate member, said wedge bar member movable between a first position and a second position;

a spring assembly, said spring assembly having at least one spring, said at least one spring operably coupled intermediate said rear wall of said body and said wedge bar member;

a control cylinder, said control cylinder disposed within said body, said control cylinder having a piston operably engaged with said wedge bar member, said control cylinder operable to move said wedge bar member to said first position; and a lock assembly, said lock assembly being operably coupled to said wedge bar member, said lock assembly having a pin member, said pin member of said lock assembly configured to move in an upwards-downwards motion between a first position and a second position, said lock assembly configured to retain said wedge bar member in said second position, wherein said wedge bar member includes a center section intermediate said first end and said second end of said wedge bar member, said center section having formed therein a lock assembly aperture, said lock assembly further comprising a housing, said housing having a portion configured to be journaled into said lock assembly aperture, said lock assembly being operably coupled to said center section of said wedge bar member.

2. The implement coupling apparatus configured to facilitate coupling and de-coupling of an implement to machinery as recited in claim 1, and further including a controller, said controller being operably coupled to said control cylinder, said controller configured to provide operation of said control cylinder.

3. The implement coupling apparatus configured to facilitate coupling and de-coupling of an implement to machinery as recited in claim 2, wherein said first end of said wedge bar member protrudes outward from said wedge bar aperture of said first side plate member.

4. The implement coupling apparatus configured to facilitate coupling and de-coupling of an implement to machinery as recited in claim 3, wherein said second end of said wedge bar member protrudes outward from said wedge bar aperture of said second side plate member.

5. The implement coupling apparatus configured to facilitate coupling and de-coupling of an implement to machinery as recited in claim 4, wherein said first end and said second end of said wedge bar member have an upper surface that is angular in orientation.

6. The implement coupling apparatus configured to facilitate coupling and de-coupling of an implement to machinery as recited in claim 5, wherein said body further includes a lower cover member, said lower cover member further having an aperture formed therein.

7. The implement coupling apparatus configured to facilitate coupling and de-coupling of an implement to machinery as recited in claim 6, wherein said pin member of said lock assembly is configured to be journaled into said aperture of said lower cover member in said second position of said pin member.

8. The implement coupling apparatus configured to facilitate coupling and de-coupling of an implement to machinery as recited in claim 7, wherein said first end and said second end of said wedge bar member are configured to operably and mateably couple with coupling notches of the implement.

9. The implement coupling apparatus configured to facilitate coupling and de-coupling of an implement to machinery as recited in claim 8, wherein said spring assembly includes a first spring member and a second spring member, said first spring member and said second spring member being intermediate said rear wall of said body and said wedge bar member.

10. The implement coupling apparatus configured to facilitate coupling and de-coupling of an implement to machinery as recited in claim 9, wherein said first lug aperture and said second lug aperture of said first side plate member include lugging operably coupled therewith.

11. The implement coupling apparatus configured to facilitate coupling and de-coupling of an implement to machinery as recited in claim 10, wherein said first lug aperture and said second lug aperture of said second side plate member include lugging operably coupled therewith.

* * * * *